US007859176B2

(12) United States Patent
Van De Voorde

(10) Patent No.: US 7,859,176 B2
(45) Date of Patent: Dec. 28, 2010

(54) HIGH-PRESSURE DISCHARGE LAMP ASSEMBLY

(75) Inventor: Patrick Cyriel Van De Voorde, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 249 days.

(21) Appl. No.: 10/581,131

(22) PCT Filed: Nov. 23, 2004

(86) PCT No.: PCT/IB2004/052517

§ 371 (c)(1),
(2), (4) Date: May 30, 2006

(87) PCT Pub. No.: WO2005/055272

PCT Pub. Date: Jun. 16, 2005

(65) Prior Publication Data

US 2007/0114940 A1 May 24, 2007

(30) Foreign Application Priority Data

Dec. 2, 2003 (EP) ..... 03104487

(51) Int. Cl.
*H01J 5/16* (2006.01)
*H01J 61/40* (2006.01)
*H01K 1/26* (2006.01)
*H01K 1/30* (2006.01)

(52) U.S. Cl. ..... 313/113; 313/110; 313/631; 313/634; 313/318.01; 313/318.11

(58) Field of Classification Search ..... 313/567–643, 313/110, 113, 318.01, 318.11
See application file for complete search history.

(56) References Cited

U.S. PATENT DOCUMENTS

| | | | | |
|---|---|---|---|---|
| 3,700,881 | A | 10/1972 | Slomski | |
| 5,466,981 | A | 11/1995 | Fields et al. | |
| 5,698,936 | A * | 12/1997 | Marien et al. | 313/318.11 |
| 5,945,776 | A * | 8/1999 | Koster et al. | 313/113 |
| 6,525,454 | B2 * | 2/2003 | Calon et al. | 313/318.03 |
| 2004/0155594 | A1 * | 8/2004 | Kika | 315/169.3 |

FOREIGN PATENT DOCUMENTS

| | | | |
|---|---|---|---|
| JP | 09288902 | A | 11/1997 |
| WO | 0239012 | A | 5/2002 |
| WO | WO 03022013 | * | 3/2003 |

* cited by examiner

*Primary Examiner*—Nimeshkumar D Patel
*Assistant Examiner*—Thomas A Hollweg

(57) ABSTRACT

A high-pressure discharge lamp assembly has a discharge lamp (1) and a concave reflector (11) arranged around a longitudinal axis (30). The discharge lamp is closed in a gastight manner and comprises a first and second end portion (3, 4) and an ionizable gas filling, and in which a pair of electrodes (5, 6) is arranged. A first and a second current-supply conductor (7, 8) are connected to the pair of electrodes and issue to the exterior of the discharge lamp (1). The first end portion of the discharge lamp extends through an opening (14) arranged in a center section of the reflector. A conduction member (9) is connected to the second current-supply conductor and extends through the opening in the center section of the reflector. The conduction member is connected to a contact member provided on a surface of the reflector facing away from the discharge lamp.

12 Claims, 3 Drawing Sheets

HIGH-PRESSURE DISCHARGE LAMP ASSEMBLY

The invention relates to a high-pressure discharge lamp assembly comprising a reflector and a discharge lamp.

High-pressure discharge lamps in reflectors are designed for use in scenic illumination when positioned inside a reflector, for example, for photo, film, or video shots. In addition, the high-pressure discharge lamp assemblies are used in a so-called projecting apparatus for projecting images, videos, etc. Such a projecting apparatus generally incorporates liquid crystal display technology.

High-pressure discharge lamps, for instance Ultra-High Performance (UHP) lamps, are used in the following applications: shop lighting, home lighting, head lamps, accent lighting, sport lighting, theater lighting, consumer television applications and fiber-optics applications.

Generally, high-pressure discharge lamps of the kind mentioned in the opening paragraph either have a discharge vessel with a ceramic wall or have a quartz glass discharge vessel. Such high-pressure discharge lamps are widely used in practice and combine a high luminous efficacy with favorable color properties. The discharge vessel of the lamp can contain one or several metal halides in addition to Hg and a rare gas filling.

Japanese Patent Application JP-A 9 288 902 describes a high-pressure discharge lamp assembly comprising a discharge lamp and a concave reflector. The discharge lamp is of the sealed-end type comprising a first and a second end portion and an ionizable gas filling. In the discharge lamp a pair of electrodes is arranged. One of the end portions of the discharge lamp is mounted and held in an opening at the root of the concave reflector. In order to improve the electrical safety requirements, one of the electrical connection means is connected to an external lead rod via a hole in the concave portion of the reflector.

A drawback of the known high-pressure discharge lamp assembly is that holes have to be drilled in the concave portion of the reflector for passing through the electrical connection means rendering the manufacture of the high-pressure discharge lamp assembly relatively complicated.

The invention has for its object to eliminate the above disadvantage wholly or partly. According to the invention, a high-pressure discharge lamp assembly of the kind mentioned in the opening paragraph for this purpose comprises:

a discharge lamp and a reflector arranged around a longitudinal axis, the discharge lamp being closed in a gastight manner and comprising a first and second end portion and an ionizable gas filling, and in which a pair of electrodes is arranged, a first and a second current-supply conductor being connected to the pair of electrodes and issuing to the exterior of the discharge lamp the first end portion of the discharge lamp extending through an opening arranged in a center section of the reflector, a conduction member being connected to the second current-supply conductor and extending through the opening in the center section of the reflector, the conduction member being connected to a contact member provided on a surface of the reflector facing away from the discharge lamp.

By extending the conduction member through the opening in the center section of the reflector and by connecting the conduction member to a (electrical) contact member provided on a surface of the reflector facing away from the discharge lamp, a high-pressure discharge lamp assembly is obtained in which drilling of holes in the concave portion of the reflector is avoided. The conduction member runs alongside the discharge lamp and extends through the opening in the center section of the reflector. The high-pressure discharge lamp assembly according to the invention has two electrical contacts at the same side of the discharge lamp making the mechanical and electrical connection of the assembly to the power supply relatively easy. The electrical safety requirements which are rather severe, in particular for high-wattage discharge lamps and for lamps with a high ignition voltage, are met with the high-pressure discharge lamp assembly according to the invention. In addition, the discharge lamps according to the invention are compact high-pressure discharge lamps.

Preferably, the reflector is provided with a neck portion arranged around the longitudinal axis, the conduction member being provided on a surface of the neck portion facing away from the discharge lamp. The neck portion of the reflector is an extension of the center portion of the reflector. The neck portion accommodates the discharge lamp in the reflector and ensures the proper positioning of the discharge lamp in the reflector.

Another preferred embodiment of the high-pressure discharge lamp assembly is characterized in that the lamp cap is provided with an opening for passing through the conduction member.

Preferably, the discharge lamp is mounted in a fixation means provided in the neck portion of the reflector, the conduction member being guided through the fixation means. The fixation means is, preferably, a cement or other suitable cementing material and ensures the proper positioning of the discharge lamp in the reflector. In an alternative embodiment the fixation means comprises a mechanical construction for fixating the discharge lamp in the reflector.

In a preferred embodiment of the high-pressure discharge lamp assembly according to the invention the contact member is provided as a circular conducting strip around the reflector. The circular conducting strip allows insertion of the high-pressure discharge lamp assembly into a holder in any rotational position.

In a further preferred embodiment of the high-pressure discharge lamp assembly a further contact member is provided on the surface of the reflector, the further contact member being connected to the first current-supply conductor. Preferably, the further contact member is provided as a circular conducting strip around the reflector. The (further) conducting strip allows insertion of the high-pressure discharge lamp assembly into a holder in any rotational position.

Another preferred embodiment of the high-pressure discharge lamp assembly is characterized in that the neck portion of the reflector is provided with a substantially rotationally symmetrical lamp cap of an insulating material, the lamp cap being provided with the contact member. The lamp cap provides that the dimensions of the high-pressure discharge lamp assembly can be relatively small. In addition, the safety requirements can still be met by providing a suitable lamp cap of an insulating material.

In a preferred embodiment of the high-pressure discharge lamp assembly according to the invention the contact member is provided as a circular conducting strip around the lamp cap. Preferably, the lamp cap is provided with a multiplicity of indents for fixating the contact member. The indents provide a fixation means for fixating the conductive strips on the lamp cap.

Another preferred embodiment of the high-pressure discharge lamp assembly is characterized in that the further contact member is provided on the lamp cap on a location where the longitudinal axis intersects the lamp cap.

These and other aspects of the invention are apparent from and will be elucidated with reference to the embodiments described hereinafter.

In the drawings.

The Figures are purely diagrammatic and not drawn to scale. Notably, some dimensions are shown in a strongly exaggerated form for the sake of clarity. Similar components in the Figures are denoted as much as possible by the same reference numerals.

Figure 1:
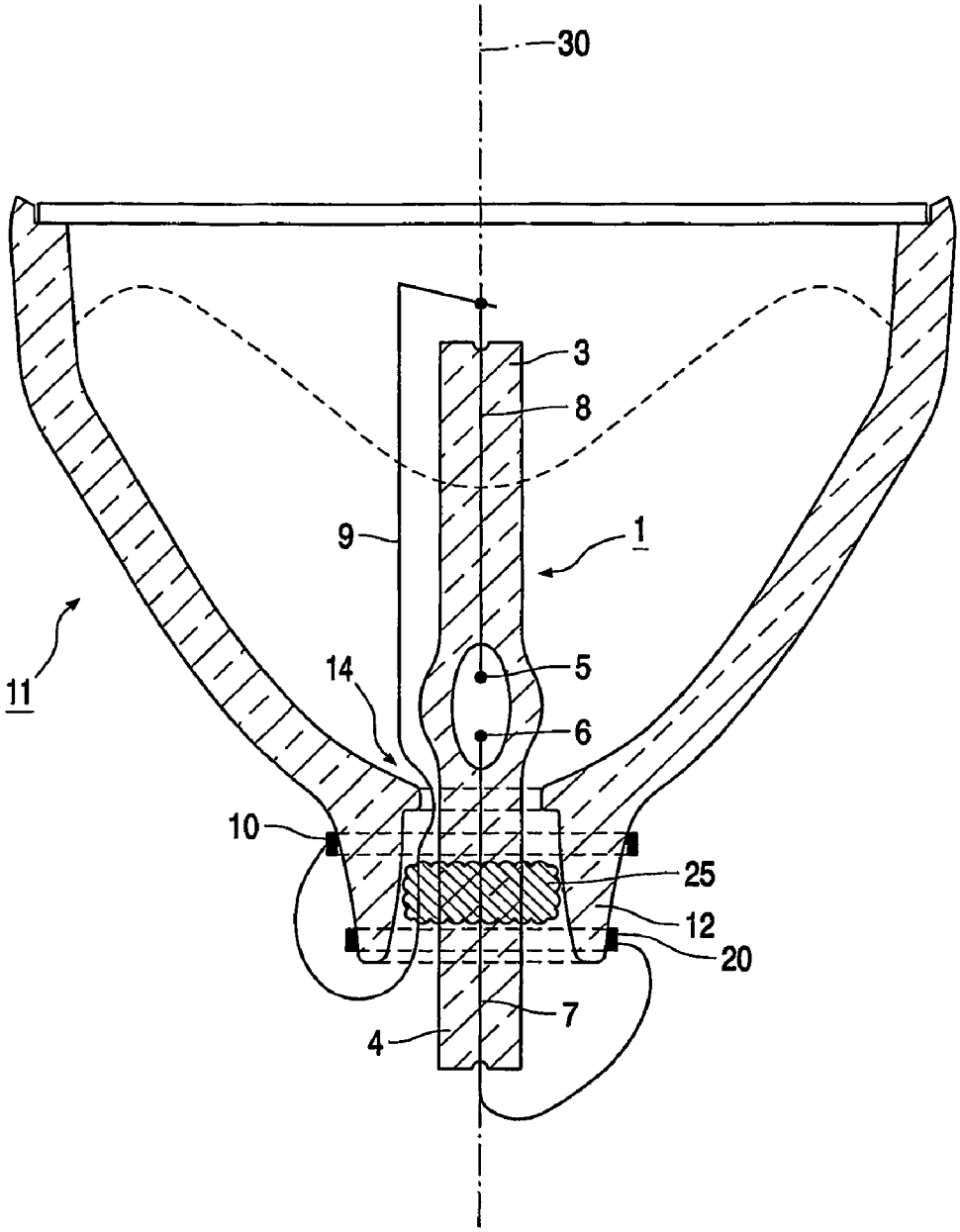
FIG. 1 shows a first embodiment of a high-pressure discharge lamp assembly according to the invention in cross-section.

FIG. 1 schematically shows a first embodiment of a high-pressure discharge lamp assembly comprising a discharge lamp 1 and a concave reflector 11 arranged around a longitudinal axis 30. The discharge lamp 1 has a ceramic wall. In the example of FIG. 1 the discharge lamp is made of quartz glass. In an alternative embodiment the wall is made from a ceramic material, for example: mono-crystalline metal oxide (for example sapphire), densely sintered polycrystalline metal oxide (for example Aluminum oxide, YAG), and densely sintered polycrystalline metal nitride (for example Aluminum nitride).

The discharge lamp 1 in FIG. 1 is closed in a gastight manner and comprises a first end portion 3 and a second end portion 4. The discharge lamp 1 encloses, in a gastight manner, a discharge space containing a filling of metal halides in addition to mercury and a rare gas filling. For ultra-high performance lamps, the discharge lamp 1 contains, apart from mercury, bromide and argon. In addition, a pair of electrodes 5, 6 is arranged in the discharge lamp 1. In the example of FIG. 1 means for maintaining a discharge in the discharge space are electrodes 5, 6 arranged in the discharge space, said electrodes 5, 6 being supported by the first and second end portions 3,4 respectively. The electrodes 5, 6 are windings of tungsten covered with an electron-emitting substance. For ultra-high performance lamps the electrodes are normally made of tungsten: a central rod with a double coil welded to the central rod.

A first current-supply conductor 7 and a second current-supply conductor 8 are connected to the pair of electrodes 5, 6. The first current-supply conductor 7 and a second current-supply conductor 8 issue to the exterior of the discharge lamp 1, specifically from the the second end portion 4 and the first end portion 3, respectively. The first end portion 3 of the discharge lamp 1 extends through an opening 14 arranged in a center section of the reflector 11. A conduction member 9 is connected to the second current-supply conductor 8. The (electrical) conduction member 9 runs alongside the discharge lamp 1 and extends through the opening 14 in the center section of the reflector 11. The conduction member 9 is connected to a (electrical) contact member 10 provided on a surface of the reflector 11 facing away from the discharge lamp 1.

In the example of FIG. 1, the reflector 11 is provided with a neck portion 12 arranged around the longitudinal axis 30. The contact member 10 is provided on a surface of the neck portion 12 facing away from the discharge lamp 1. In addition, the contact member 10 is provided as a circular conducting strip around (the neck portion of) the reflector 11. The circular conducting strip allows insertion of the high-pressure discharge lamp assembly into a holder in any rotational position.

In an alternative embodiment of the high-pressure discharge lamp assembly (not shown in FIG. 1) the neck portion 12 is provided with an opening for passing through the conduction member 9.

In the example of FIG. 1, a further contact member 20 is provided on the surface of the reflector 11. The further contact member 20 is connected to the first 7 current-supply conductor. In addition, the further contact member 20 is provided as a circular conducting strip around the reflector 11. The circular conducting strip allows insertion of the high-pressure discharge lamp assembly into a holder in any rotational position.

In FIG. 1, the discharge lamp 1 is mounted in a fixation means 25 provided in the neck portion 12 of the reflector 11. The conduction member 9 is guided through the fixation means 25. The fixation means 25 is, preferably, a cement or other suitable cementing material and ensures the proper positioning of the discharge lamp in the reflector. Generally there are two types of cements: those that dry in air and those that harden in a chemical manner. The latter cements can be divided in cements based on phosphate and on water glass. In the lighting world, preferably, cements based on water glass are employed.

Figure 2:
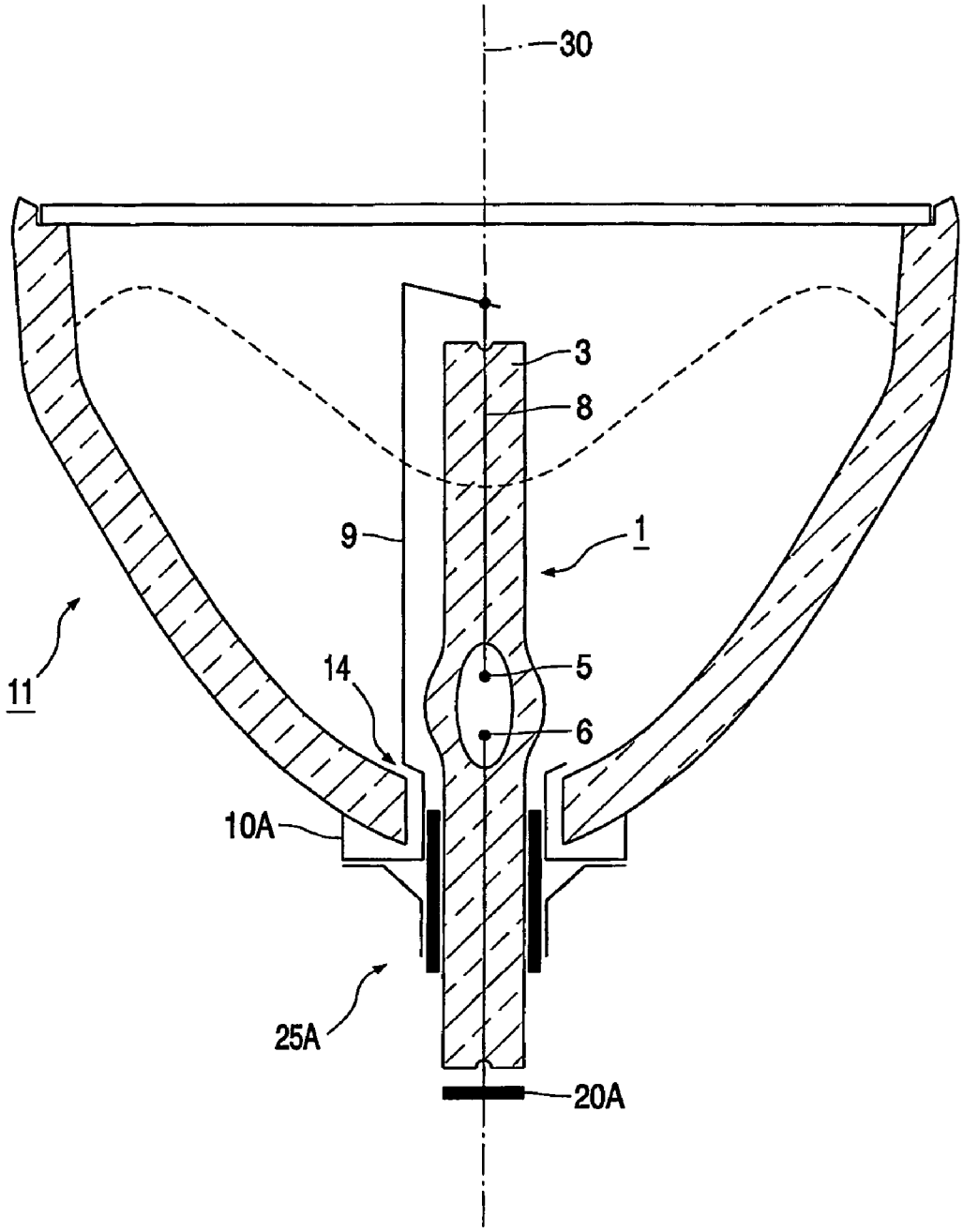
FIG. 2 shows a second embodiment of a high-pressure discharge lamp assembly according to the invention in cross-section.

FIG. 2 shows a second embodiment of a high-pressure discharge lamp assembly according to the invention in cross-section. In the embodiment of FIG. 2, the fixation means 25A comprises a mechanical construction for fixation the discharge lamp 1 in the reflector 11. In this embodiment, the reflector 11 is not provided with a neck portion. The first end portion 3 of the discharge lamp 1 extends through the opening 14 arranged in a center section of the reflector 11. The (electrical) conduction member 9 runs alongside the discharge lamp 1 and is connected to a (electrical) contact member 10A provided on a surface of the reflector 11 facing away from the discharge lamp 1. The contact member 10A extends through the opening 14 in the center section of the reflector 11. In the example of FIG. 2, the contact member 10A forms a part of the mechanical fixation means 25A. In the example of FIG. 2, the further contact member 20A is directly connected to the first 7 current-supply conductor.

Figure 3A:
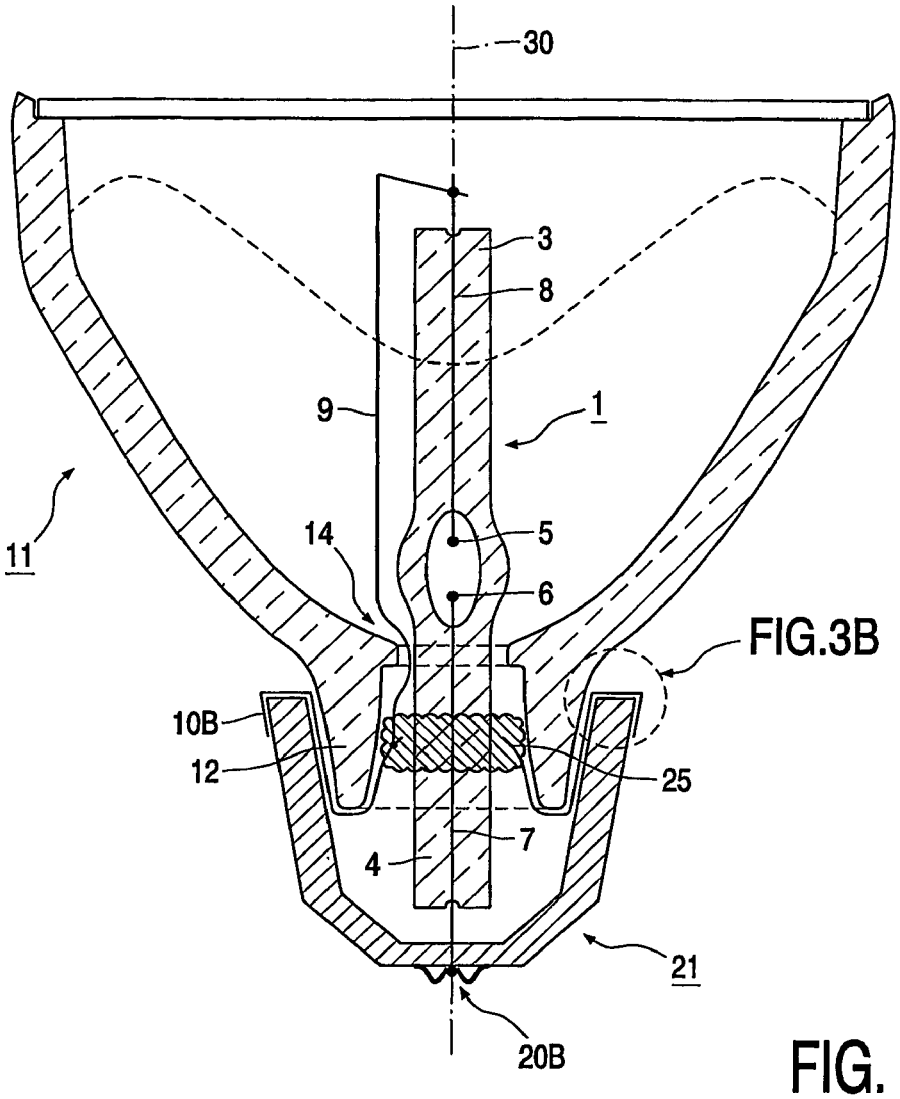
FIG. 3A shows a third embodiment of a high-pressure discharge lamp assembly according to the invention in cross-section.

FIG. 3A schematically shows a third embodiment of a high-pressure discharge lamp assembly according to the invention in cross-section. A substantially rotationally symmetrical lamp cap 21 of an insulating material is provided around the neck portion 12 of the reflector 11. In this embodiment, the lamp cap 21 is provided with the contact member 10B. In the example of FIG. 3A, the contact member 10B is provided as a circular conducting strip around the lamp cap 21. In addition, the contact member 10B is folded following in part the shape of the lamp cap 21. In the example of FIG. 3A, the contact member 10B extends into the opening 14 arranged in the center section of the reflector 11. Preferably, the contact member 10B is connected to the (electrical) conduction member 9 in the opening 14 in the center section of the reflector 11. Said electrical connection is preferably made in the fixation means 25.

The electrical safety requirements are met with the high-pressure discharge lamp assembly according to the invention, for high-wattage discharge lamps as well as for lamps with a high ignition voltage. In addition, the discharge lamps according to the invention are compact high-pressure discharge lamps.

In the embodiment of FIG. 3A, the further contact member 20B is provided on the lamp cap 21 on a location where the longitudinal axis 30 intersects the lamp cap 21. Preferably, the further contact member 20B is provided in a recessed portion of the lamp cap 21.

Figure 3B:
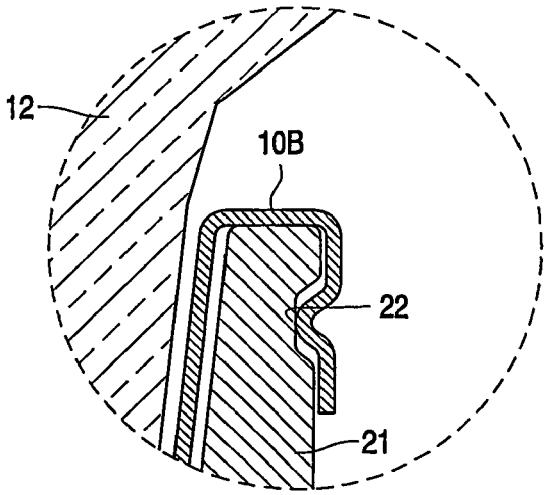
FIG. 3B shows a detail of the embodiment as shown in FIG. 3A.

FIG. 3B schematically shows a detail of the embodiment as shown in FIG. 3A. The lamp cap 21 is provided with a multiplicity of indents 22 (one of the indents is shown in FIG. 3B) for fixating the contact member 10B to the lamp cap 21.

The indents 22 provide a fixation means for fixating the contact member 10B or the corresponding conductive strips on the lamp cap 21.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A high-pressure discharge lamp assembly, comprising:

a discharge lamp and a concave reflector arranged around a longitudinal axis, the discharge lamp being closed in a gastight manner and comprising a first end portion and a second end portion and an ionizable gas filling, and in which a pair of electrodes is arranged, wherein the first end portion of the discharge lamp extends through an opening provided in a center section of the reflector, a first current-supply conductor connected to a first one of the pair of electrodes and issuing to an exterior of the discharge lamp at the first end portion of the discharge lamp;

a second current-supply conductor connected to a second one of the pair of electrodes and issuing to the exterior of the discharge lamp at the second end portion of the discharge lamp, a conduction member connected to the second current-supply conductor and extending through the opening in the center section of the reflector, and a contact member provided on a surface of the reflector facing away from the discharge lamp the contact member being connected to the conduction member, wherein the discharge lamp is mounted in a fixation means provided in the opening of the reflector.

2. The high-pressure discharge lamp assembly of claim 1, wherein the reflector is provided with a neck portion arranged around the longitudinal axis, the contact member being provided on a surface of the neck portion facing away from the discharge lamp.

3. The high-pressure discharge lamp assembly of claim 2, wherein the neck portion is provided with an opening for passing through the conduction member.

4. The high-pressure discharge lamp assembly of claim 2, wherein the neck portion of the reflector is provided with a substantially rotationally symmetrical lamp cap of an insulating material, the lamp cap being provided with the contact member.

5. The high-pressure discharge lamp assembly of claim 4, wherein the contact member is provided as a circular conducting strip around the lamp cap.

6. The high-pressure discharge lamp assembly of in claim 4, wherein the lamp cap is provided with a multiplicity of indents for fixating the contact member.

7. The high-pressure discharge lamp assembly of claim 4, wherein a further contact member is provided on the lamp cap on a location where the longitudinal axis intersects the lamp cap.

8. The high-pressure discharge lamp assembly of claim 1, wherein the contact member is provided as a circular conducting strip around the reflector.

9. The high-pressure discharge lamp assembly of claim 1, wherein a further contact member is provided on the surface of the reflector, the further contact member being connected to the first current-supply conductor.

10. The high-pressure discharge lamp assembly of claim 9, wherein the further contact member is provided as a circular conducting strip around the reflector.

11. A high-pressure discharge lamp assembly, comprising:

a discharge lamp and a concave reflector arranged around a longitudinal axis;

the discharge lamp being closed in a gastight manner and comprising a first end portion and a second end portion and an ionizable gas filling, and in which a pair of electrodes is arranged, wherein the first end portion of the discharge lamp extends through an opening provided in a center section of the reflector;

a first current-supply conductor connected to a first one of the pair of electrodes and issuing to an exterior of the discharge lamp at the first end portion of the discharge lamp;

a second current-supply conductor connected to a second one of the pair of electrodes and issuing to the exterior of the discharge lamp at the second end portion of the discharge lamp;

a conduction member connected to the second current-supply conductor and extending through the opening in the center section of the reflector; and a contact member provided on a surface of the reflector facing away from the discharge lamp, the contact member being connected to the conduction member, wherein the discharge lamp is mounted in a fixation means provided in the opening of the reflector, and wherein the conduction member is guided through the fixation means.

12. A high-pressure discharge lamp assembly, comprising:

a discharge lamp and a concave reflector arranged around a longitudinal axis;

the discharge lamp being closed in a gastight manner and comprising a first end portion and a second end portion and an ionizable gas filling, and in which a pair of electrodes is arranged, wherein the first end portion of the discharge lamp extends through an opening provided in a center section of the reflector;

a first current-supply conductor connected to a first one of the pair of electrodes and issuing to an exterior of the discharge lamp at the first end portion of the discharge lamp;

a second current-supply conductor connected to a second one of the pair of electrodes and issuing to the exterior of the discharge lamp at the second end portion of the discharge lamp;

a conduction member connected to the second current-supply conductor and extending through the opening in the center section of the reflector;

a first contact member provided as a first circular conducting strip around the reflector on a surface of the reflector facing away from the discharge lamp, the first contact member being connected to the conduction member; and a second contact member provided as a second circular conducting strip around the reflector on the surface of the reflector facing away from the discharge lamp, the second contact member being connected to the first current-supply conductor, wherein the discharge lamp is mounted in a fixation means provided in the opening of the reflector.

* * * * *